US011723493B2

(12) United States Patent
Schupman

(10) Patent No.: US 11,723,493 B2
(45) Date of Patent: Aug. 15, 2023

(54) WALK-IN HOT TUB

(71) Applicant: Albert Schupman, San Manuel, AZ (US)

(72) Inventor: Albert Schupman, San Manuel, AZ (US)

( * ) Notice: Subject to any disclaimer, the term of this patent is extended or adjusted under 35 U.S.C. 154(b) by 0 days.

(21) Appl. No.: 17/674,352

(22) Filed: Feb. 17, 2022

(65) Prior Publication Data

US 2022/0257062 A1 Aug. 18, 2022

Related U.S. Application Data

(60) Provisional application No. 63/150,495, filed on Feb. 17, 2021.

(51) Int. Cl.
*A47K 3/00* (2006.01)
*A61H 33/00* (2006.01)

(52) U.S. Cl.
CPC ..... *A47K 3/006* (2013.01); *A61H 33/0087* (2013.01); *A61H 33/6005* (2013.01)

(58) Field of Classification Search
CPC . A47K 3/006; A61H 33/0087; A61H 33/6005
USPC ..... 4/555
See application file for complete search history.

(56) References Cited

U.S. PATENT DOCUMENTS 3,460,166 A 8/1969 Weber
3,604,018 A 9/1971 Moran
3,864,762 A 2/1975 Finch et al.
4,930,168 A 6/1990 Ferlise
5,423,095 A * 6/1995 Bearer ..... A47K 3/14 4/514
5,446,929 A 9/1995 Sills et al.
8,667,622 B2 3/2014 Truman et al.
8,732,871 B2 5/2014 Neidich et al.
8,784,278 B2 7/2014 Flake et al.
9,386,887 B2 7/2016 Haddad
9,392,912 B2 7/2016 Haddad
9,693,647 B2 7/2017 Ebenspanger
D842,972 S 3/2019 O'Brien
11,085,178 B1 * 8/2021 Oliver ..... E03C 1/20
2010/0325789 A1 * 12/2010 Ouyoung ..... A47K 3/006 4/555

(Continued)

FOREIGN PATENT DOCUMENTS

EP 0015355 A1 9/1980
EP 1428467 A1 6/2004

(Continued)

*Primary Examiner* — Huyen D Le
(74) *Attorney, Agent, or Firm* — Nguyen Tarbet LLC

(57) ABSTRACT

A walk-in hot tub which can enable one or more users to walk into and out of a hot tub in a dry state may include a hot tub compartment. The hot tub compartment may have a hot tub compartment interior. A tub transfer compartment may be disposed adjacent to the hot tub compartment. The tub transfer compartment may have a transfer compartment interior. An openable transfer compartment door may provide walking access to a user from outside the tub transfer compartment into the transfer compartment interior of the tub transfer compartment. An openable hot tub compartment door may provide walking access to one or more users between the hot tub compartment interior of the hot tub compartment and the transfer compartment interior of the tub transfer compartment.

17 Claims, 14 Drawing Sheets

(56) References Cited

U.S. PATENT DOCUMENTS

Figure 1:
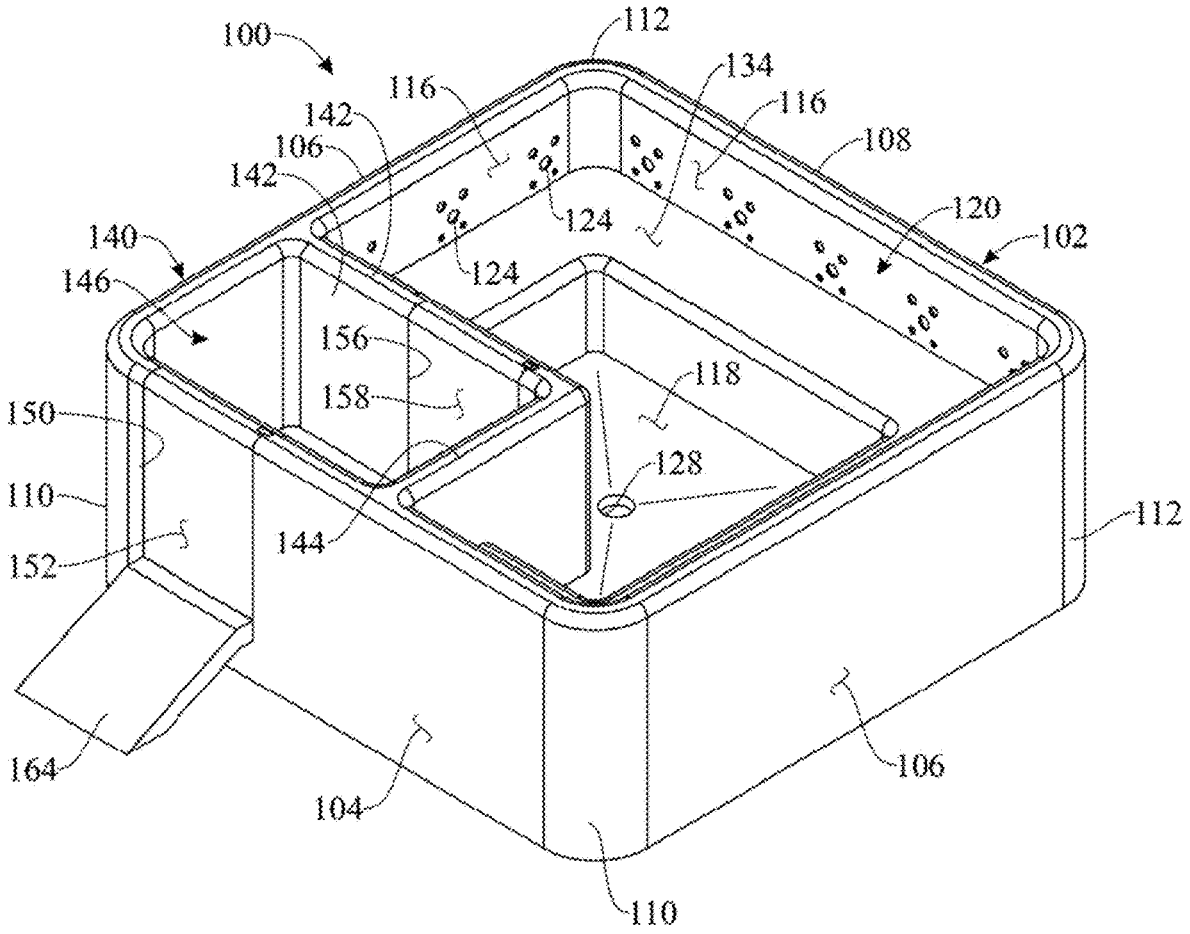

| | | | | |
|---|---|---|---|---|
| 2016/0374897 | A1 | 12/2016 | Carey et al. | |
| 2022/0279983 | A1 * | 9/2022 | Watson | A47K 3/34 |

FOREIGN PATENT DOCUMENTS

| | | | |
|---|---|---|---|
| EP | 1604712 | A1 | 12/2005 |
| GB | 2365765 | A | 2/2002 |
| GB | 2406787 | A | 4/2005 |
| GB | 2500036 | A | 9/2013 |
| JP | 2002360460 | A | 12/2002 |
| WO | WO2010026156 | A1 | 3/2010 |
| WO | WO2014170344 | A2 | 10/2014 |
| WO | WO2015185838 | A1 | 12/2015 |

* cited by examiner

WALK-IN HOT TUB

CROSS-REFERENCES TO RELATED APPLICATIONS

This application is a non-provisional and claims benefit of U.S. Provisional Application No. 63/150,495 filed Feb. 17, 2021, the specification of which is incorporated herein in its entirety by reference.

FIELD OF THE INVENTION

The present invention relates generally to baths, spas, hot tubs and the like, and more particularly, to a walk-in hot tub having a tub entry compartment which enables a user to walk into and out of the hot tub in a dry state.

BACKGROUND OF THE INVENTION

A hot tub, or spa, is a pool which is filled with water for the purpose of relaxation or pleasure. In some applications, hot tubs may be used for hydrotherapy. A hot tub may be sufficiently large to simultaneously accommodate multiple persons and may be installed indoors or outdoors.

A typical conventional hot tub may include a tub wall and a tub floor which form a hot tub interior. A seat may be formed in the hot tub interior to accommodate multiple persons as the persons sit in the hot tub interior. At least one drain opening may be provided in the tub floor. Water jets extend through the wall and communicate with the hot tub interior. A pump, filter and water heater communicate with the drain opening and the water jets to circulate water from the drain opening, heat and filter the water and discharge the heated and filtered water back into the hot tub interior through the water jets.

Hot tubs utilize hot water which is typically comforting and, in some cases, therapeutic for many persons. Hot tubs may be installed outdoors under a cover and are typically constructed of wood, plastic, or fiberglass. The water heater may be gas or electric. Because the water in the hot tub is typically not replaced between uses, the water filter and additive chemicals are frequently used to sanitize the water.

Some types of hot tubs may be recessed into an outdoor deck or an indoor platform or other surface. Accordingly, a user of the hot tub may simply step down from the deck or surface into the hot tub with relative ease. Other types of hot tubs may be self-standing with sidewalls which extend upwardly from a support surface. Therefore, the hot tub user may be required to step over the sidewall in order to access the hot tub interior. A user who is physically challenged may therefore encounter difficulty in traversing the sidewall into the hot tub interior. In some cases, the physically challenged person may sit on the sidewall and then lift and swing his or her legs over the sidewall before descending from the sidewall into the tub interior. However, this procedure may be difficult and hazardous for such a person to accomplish without assistance.

Accordingly, there is a need for a walk-in hot tub having a tub entry compartment which enables a user to walk into and out of the hot tub in a dry state.

BRIEF SUMMARY OF THE INVENTION

It is an objective of the present invention to provide systems and devices that allow for baths, spas, hot tubs and the like, and more particularly, a walk-in hot tub having a tub entry compartment which enables a user to walk into and out of the hot tub in a dry state, as specified in the independent claims. Embodiments of the invention are given in the dependent claims. Embodiments of the present invention can be freely combined with each other if they are not mutually exclusive.

The present invention is directed to a walk-in hot tub which may enable a user to walk into and out of the hot tub in a dry state.

In some embodiments, the walk-in hot tub that allows a user to walk into and out of the hot tub in a dry state comprises a hot tub compartment and a tub transfer compartment coupled to the hot tub compartment. The tub transfer compartment may comprise a transfer compartment door configured to move between closed and opened positions allowing entry to and exit from the hot tub, and a hot tub compartment door configured to move between closed and opened positions coupling the tub transfer compartment to the hot tub compartment. The hot tub may further comprise a transfer compartment pump disposed in fluid communication with the tub transfer compartment. The transfer compartment pump may be configured to pump water to and from the tub transfer compartment, allowing the user to walk into and out of the hot tub in a dry state.

In some embodiments, the hot tub may further comprise a hot tub compartment drain opening disposed on a tub floor of the hot tub compartment, one or more water jet nozzles disposed on an inner tub wall of the hot tub compartment, and a hot tub pump fluidly connected to the hot tub compartment drain opening and the one or more water jet nozzles by a tub pump conduit, configured to pump the water from the hot tub compartment drain opening through the one or more water jet nozzles in order to circulate the water in the hot tub compartment. The transfer compartment pump may be fluidly connected to the hot tub pump by a transfer compartment pump conduit such that the water pumped from the transfer compartment is transferred by the hot tub pump through the one or more water jet nozzles to the hot tub compartment. The hot tub may further comprise one or more water heaters disposed along the tub pump conduit such that the water pumped by the hot tub pump is heated, and one or more water filters disposed along the tub pump conduit such that the water pumped by the hot tub pump is filtered.

The hot tub pump may be fluidly connected to an external source of water such that the hot tub compartment can be refilled. The transfer compartment door may comprise a gasket to facilitate a fluid-tight seal when the transfer compartment door is in the closed position. The hot tub compartment door may comprise a gasket to facilitate a fluid-tight seal when the hot tub compartment door is in the closed position. The hot tub compartment may further comprise a tub seat. The hot tub may further comprise a sloped entry ramp coupled to the transfer compartment door. The hot tub may further comprise a water bladder fluidly connected to the transfer compartment, configured to contain a sufficient quantity of water to fill the transfer compartment and maintain a constant level of the water in the transfer compartment preparatory to opening of the hot tub compartment door.

In an illustrative implementation of the invention, a walk-in hot tub which can enable one or more users to walk into and out of a hot tub in a dry state may include a hot tub compartment. A tub transfer compartment may be disposed adjacent to the hot tub compartment. An openable transfer compartment door may provide access to the tub transfer compartment. An openable hot tub compartment door may provide walking access to one or more users between the tub transfer compartment and the hot tub compartment. The hot tub compartment may have a hot tub compartment interior. The tub transfer compartment may have a transfer compartment interior. The openable transfer compartment door may be disposed exterior to the tub transfer compartment. The transfer compartment door may provide walking access to a user from outside the tub transfer compartment into the transfer compartment interior of the tub transfer compartment. The openable hot tub compartment door may be disposed between the hot tub compartment interior of the hot tub compartment and the transfer compartment interior of the tub transfer compartment. The hot tub compartment door may provide walking access to one or more users between the hot tub compartment interior of the hot tub compartment and the transfer compartment interior of the tub transfer compartment.

In typical application of the walk-in hot tub, the hot tub compartment interior of the hot tub compartment may be filled with water. The transfer compartment door may be opened to enable one or more users to walk from outside the walk-in hot tub into the transfer compartment interior of the tub transfer compartment. The transfer compartment door may then be closed to seal the transfer compartment interior, after which the hot tub compartment door may be opened to allow the user to walk from the transfer compartment interior into the hot tub compartment interior of the hot tub compartment.

After use, the hot tub compartment door may be opened to enable the user to walk from the hot tub compartment interior into the transfer compartment interior of the tub transfer compartment. The hot tub compartment door may be closed, and water may be drained from the transfer compartment interior of the tub transfer compartment. The transfer compartment door may then be opened to enable the user to walk from the transfer compartment interior.

In a second aspect, at least one tub seat may be provided in the hot tub compartment interior of the hot tub compartment.

In another aspect, the hot tub compartment may include a tub floor and a front wall segment, a pair of side wall segments and a rear wall segment extending from the tub floor.

In another aspect, at least one transfer compartment drain may be provided in the tub floor of the hot tub compartment.

In another aspect, the tub transfer compartment may include a transfer compartment floor and at least one transfer compartment wall which extends from the transfer compartment floor and separates the transfer compartment interior of the tub transfer compartment from the hot tub compartment interior of the hot tub compartment.

In another aspect, the at least one transfer compartment wall may include an inner transfer compartment wall and a side transfer compartment wall.

In another aspect, the inner transfer compartment wall may extend from one of the side wall segments and the side transfer compartment wall may extend from the front wall segment to the inner transfer segment wall.

In another aspect, the transfer compartment door may be provided in the front wall segment.

In another aspect, the hot tub compartment door may be provided in the inner transfer compartment wall.

In another aspect, a transfer compartment door opening may extend through the front wall segment, and the transfer compartment door may be disposed in the transfer compartment door opening.

In another aspect, a hot tub compartment door opening may extend through the inner transfer compartment wall, and the hot tub compartment door may be disposed in the hot tub compartment door opening.

In another aspect, the transfer compartment door may be pivotally mounted in the transfer compartment door opening.

In another aspect, the hot tub compartment door may be pivotally mounted in the hot tub compartment door opening.

In another aspect, the transfer compartment door may be slidably mounted in the transfer compartment door opening.

In another aspect, a sloped entry ramp may extend from the transfer compartment door opening.

In another aspect, the hot tub compartment door may be slidably mounted in the hot tub compartment door opening.

In another aspect, a plurality of water jet openings may be provided in at least one of the front wall segment, the side wall segments and the rear wall segment of the hot tub compartment.

In another aspect, at least one pump system may facilitate circulation of water into and from the hot tub compartment interior of the hot tub compartment.

In another aspect, the at least one pump system may be disposed in fluid communication with the hot tub compartment drain opening and the plurality of water jet openings in the hot tub compartment.

In another aspect, the at least one pump system may be disposed in fluid communication with the transfer compartment drain opening of the transfer compartment.

In another aspect, the at least one pump system may include a tub pump disposed in fluid communication with the hot tub compartment drain opening and the plurality of water jet openings of the hot tub compartment.

In another aspect, the at least one pump system may include a transfer compartment pump disposed in fluid communication with the at least one transfer compartment drain opening of the tub transfer compartment.

In another aspect, the at least one pump system may include at least one water filter.

These and other objects, features, and advantages of the present invention will become more readily apparent from the attached drawings and the detailed description of the preferred embodiments, which follow.

One of the unique and inventive technical features of the present invention is the implementation of a transfer compartment in a hot tub such that water is pumped to and from the transfer compartment. Without wishing to limit the invention to any theory or mechanism, it is believed that the technical feature of the present invention advantageously provides for gradual acclimation to water upon entering the hot tub as well as the exiting of the hot tub in a dry state. None of the presently known prior references or work has the unique inventive technical feature of the present invention.

Furthermore, the inventive technical feature of the present invention contributed to a surprising result. For example, one skilled in the art would not recommend the implementation of a pump system for filling up the transfer compartment, instead implementing a bulkhead that is released to rapidly fill the transfer compartment with water. This is due to the amount of time necessary to utilize a pump system to fill a transfer chamber. Surprisingly, the implementation of a pump in the present invention provides for gradual and comfortable entry into a hot tub through use of the same system that allows for a user to exit the hot tub in a dry state. Thus, the inventive technical feature of the present invention contributed to a surprising result.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

Figure 2:
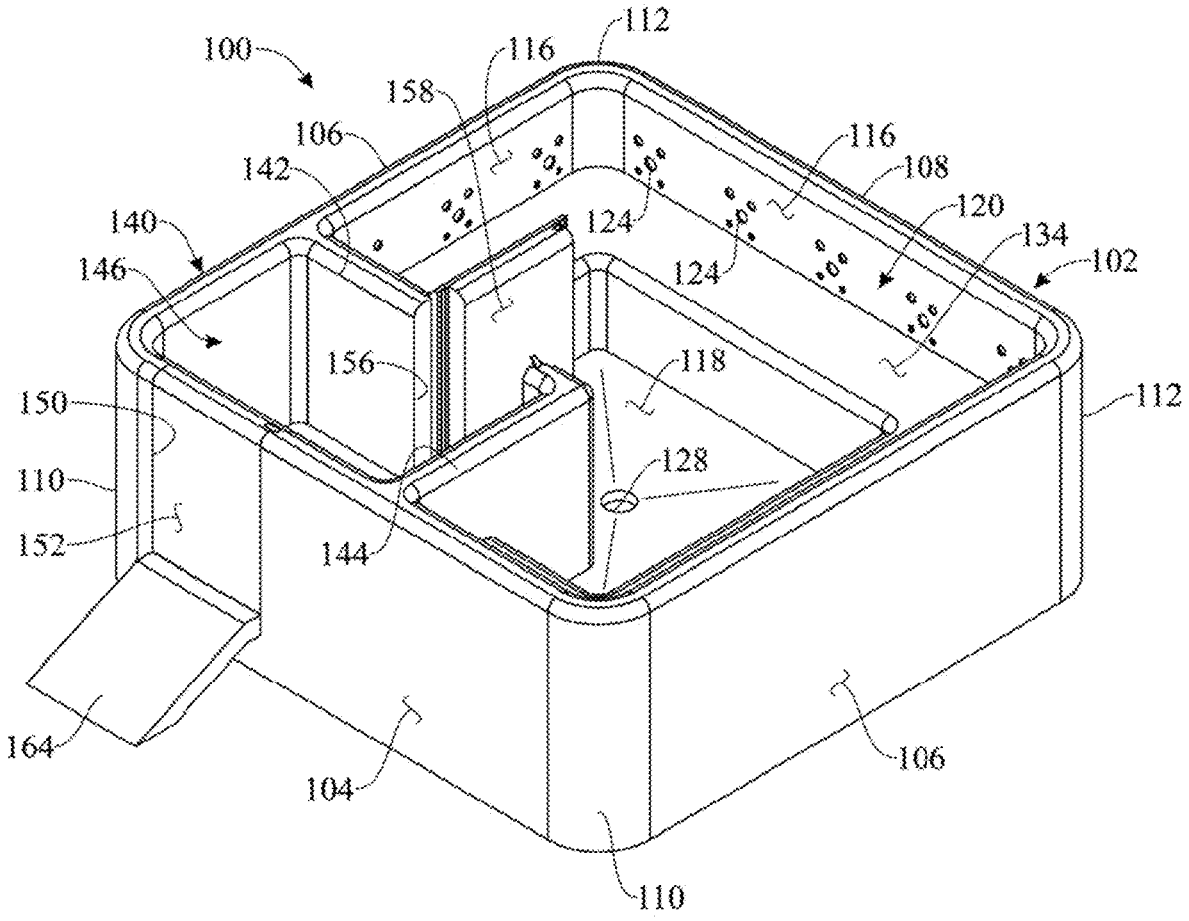
Figure 3:
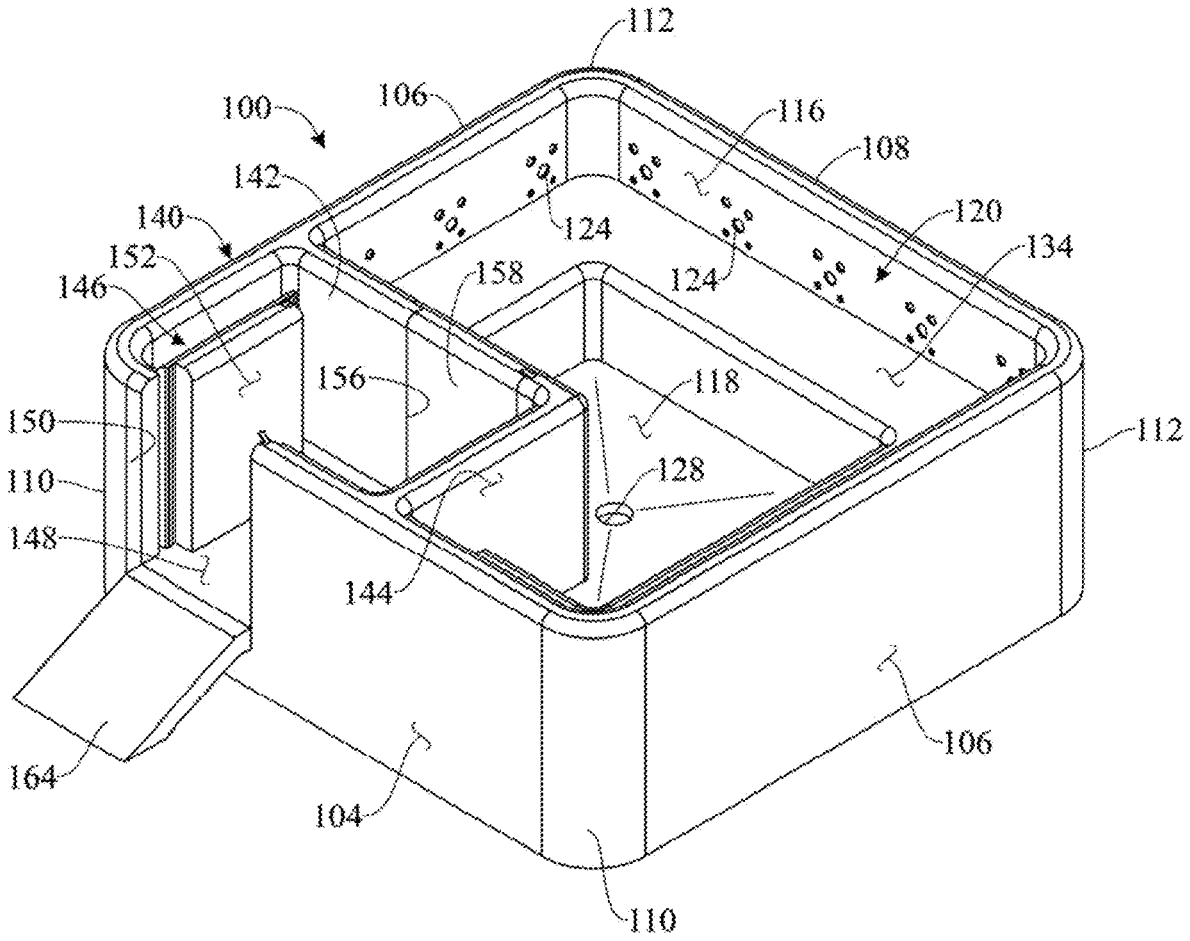
Figure 4:
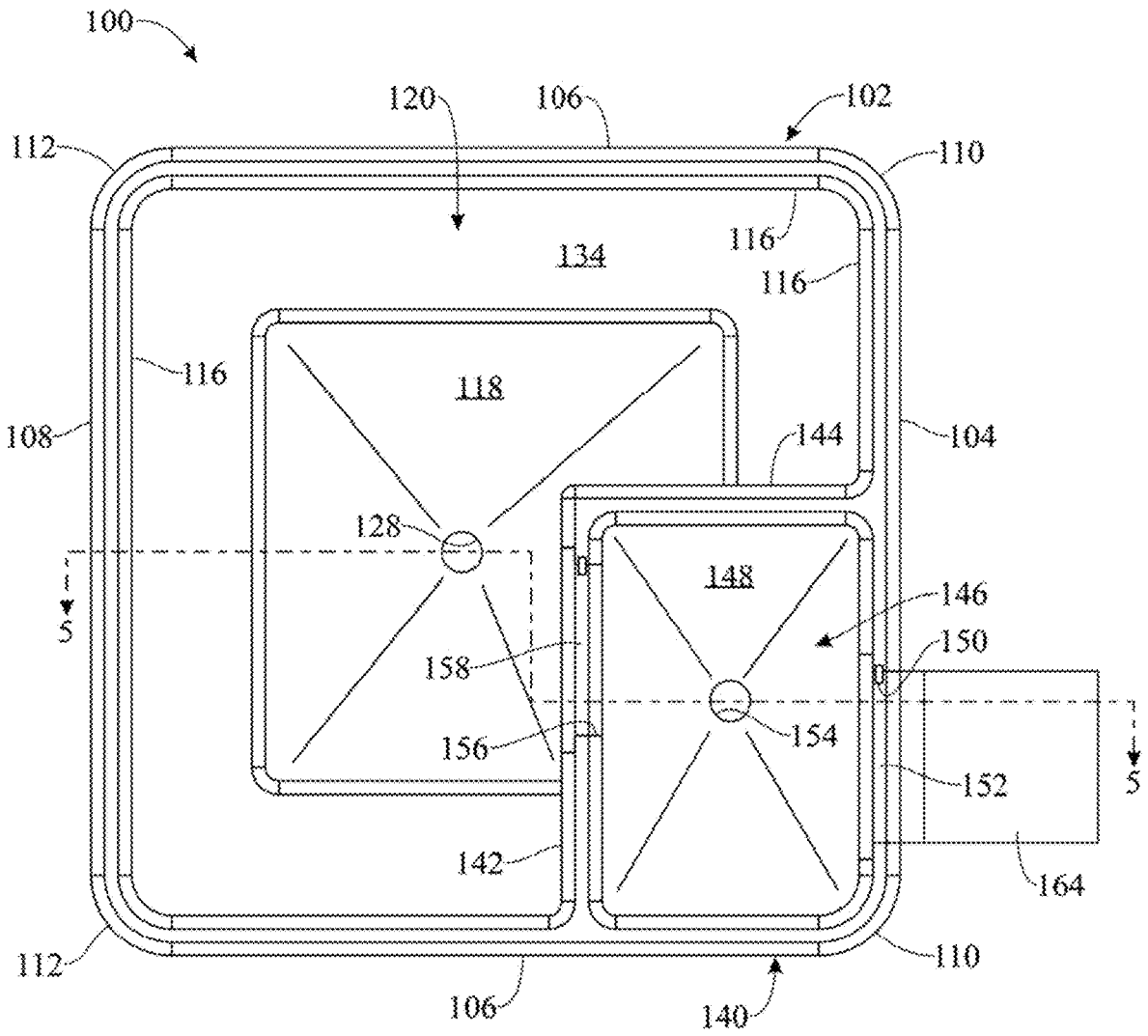
Figure 5:
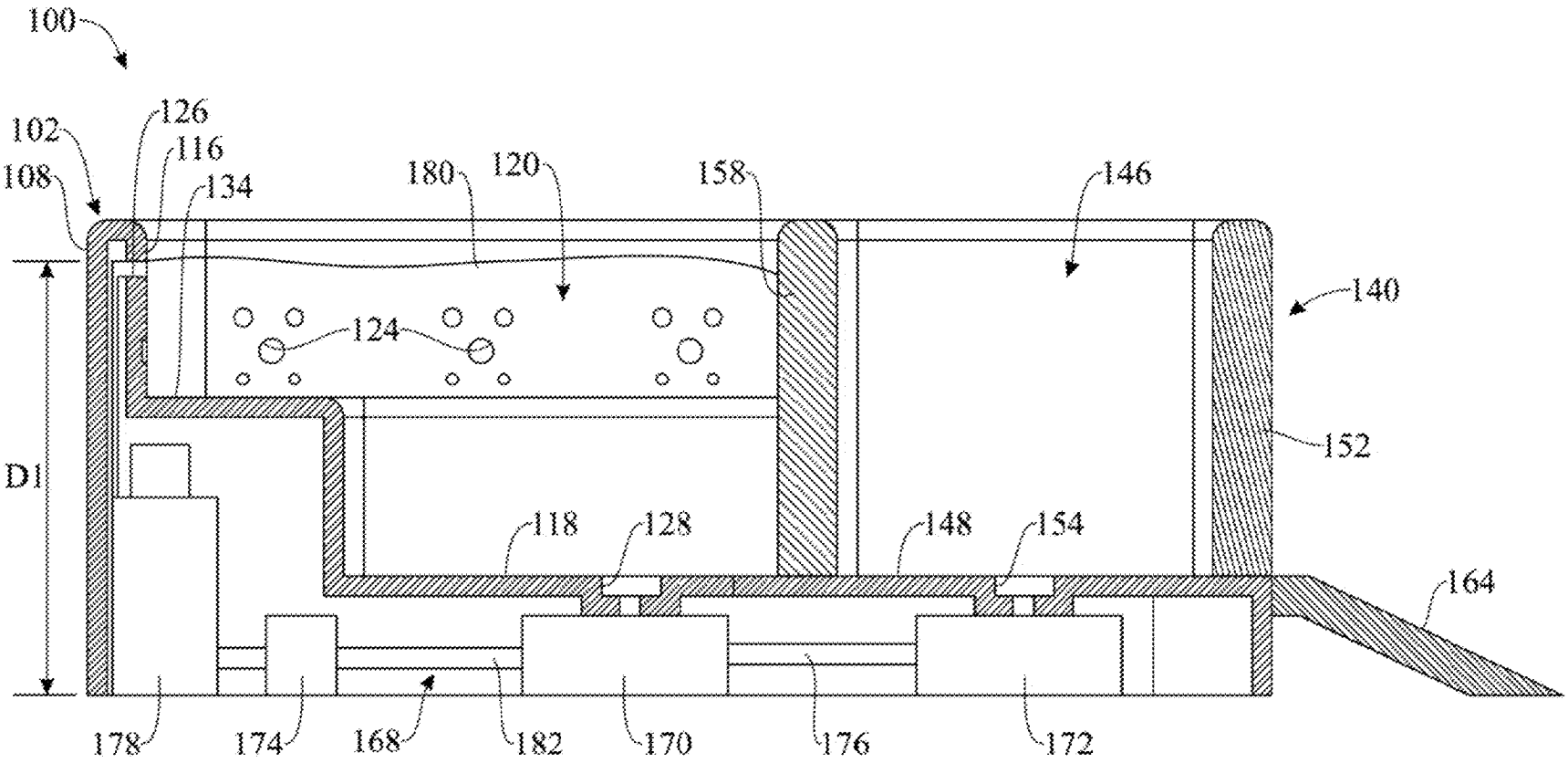
Figure 6:
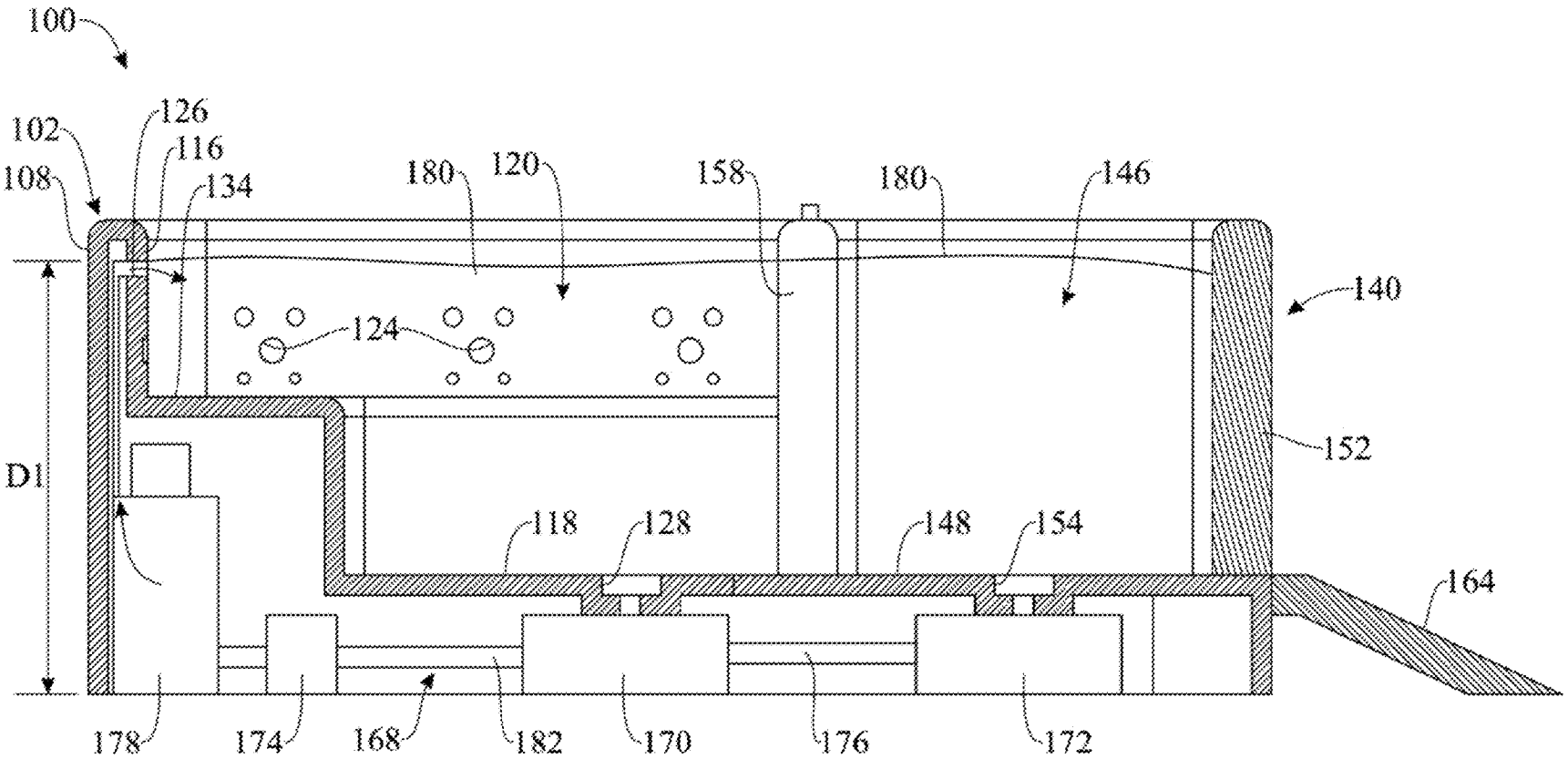
Figure 7:
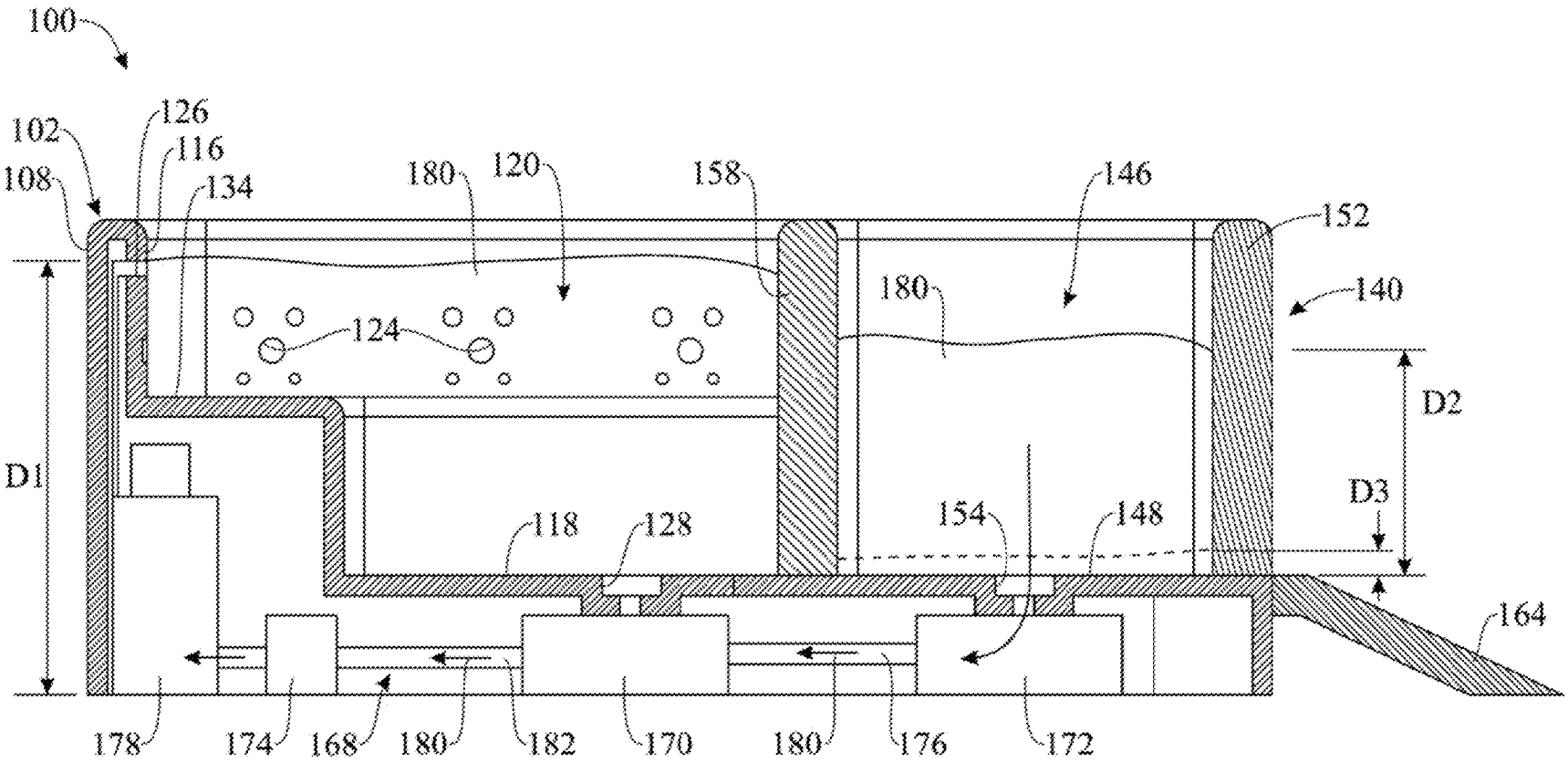
Figure 8:
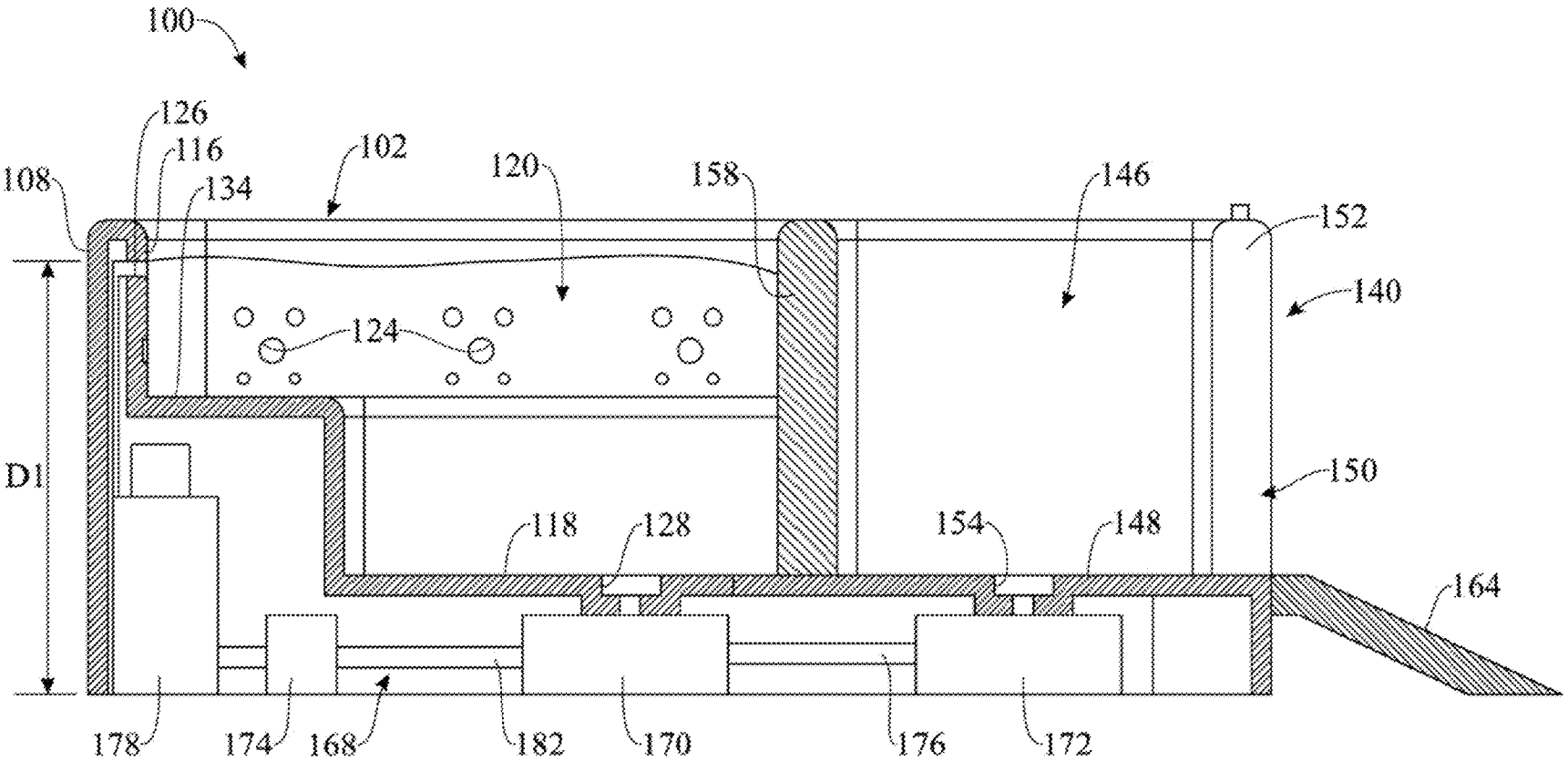

The features and advantages of the present invention will become apparent from a consideration of the following detailed description presented in connection with the accompanying drawings in which:

FIG. 1 presents a front perspective view of a walk-in hot tub in accordance with an illustrative embodiment of the present invention, with the hot tub compartment door between the tub transfer compartment and the hot tub compartment in the closed position;

FIG. 2 presents a front perspective view of a walk-in hot tub in accordance with an illustrative embodiment of the present invention, with the hot tub compartment door between the tub transfer compartment and the hot tub compartment in the open position;

FIG. 3 presents a front perspective view of a walk-in hot tub, with the transfer compartment door in the open position;

FIG. 4 presents a top view of the walk-in hot tub, with the hot tub compartment door and the transfer compartment door in the respective closed positions;

FIG. 5 presents a sectional view, taken along section lines 5-5 in FIG. 4, of the walk-in hot tub, with water filling the hot tub compartment interior of the hot tub compartment;

FIG. 6 presents a sectional view, also taken along section lines 5-5 in FIG. 4, of the walk-in hot tub, with water filling the hot tub compartment interior of the hot tub compartment and the transfer compartment interior of the transfer compartment;

FIG. 7 presents a sectional view, taken along section lines 5-5 in FIG. 4, of the walk-in hot tub, with water filling the hot tub compartment interior and being drained from the transfer compartment interior; and FIG. 8 is a sectional view, taken along section lines 5-5 in FIG. 4, of the walk-in hot tub, with water filling the hot tub compartment interior and the transfer compartment interior completely drained of water.

Figure 9:
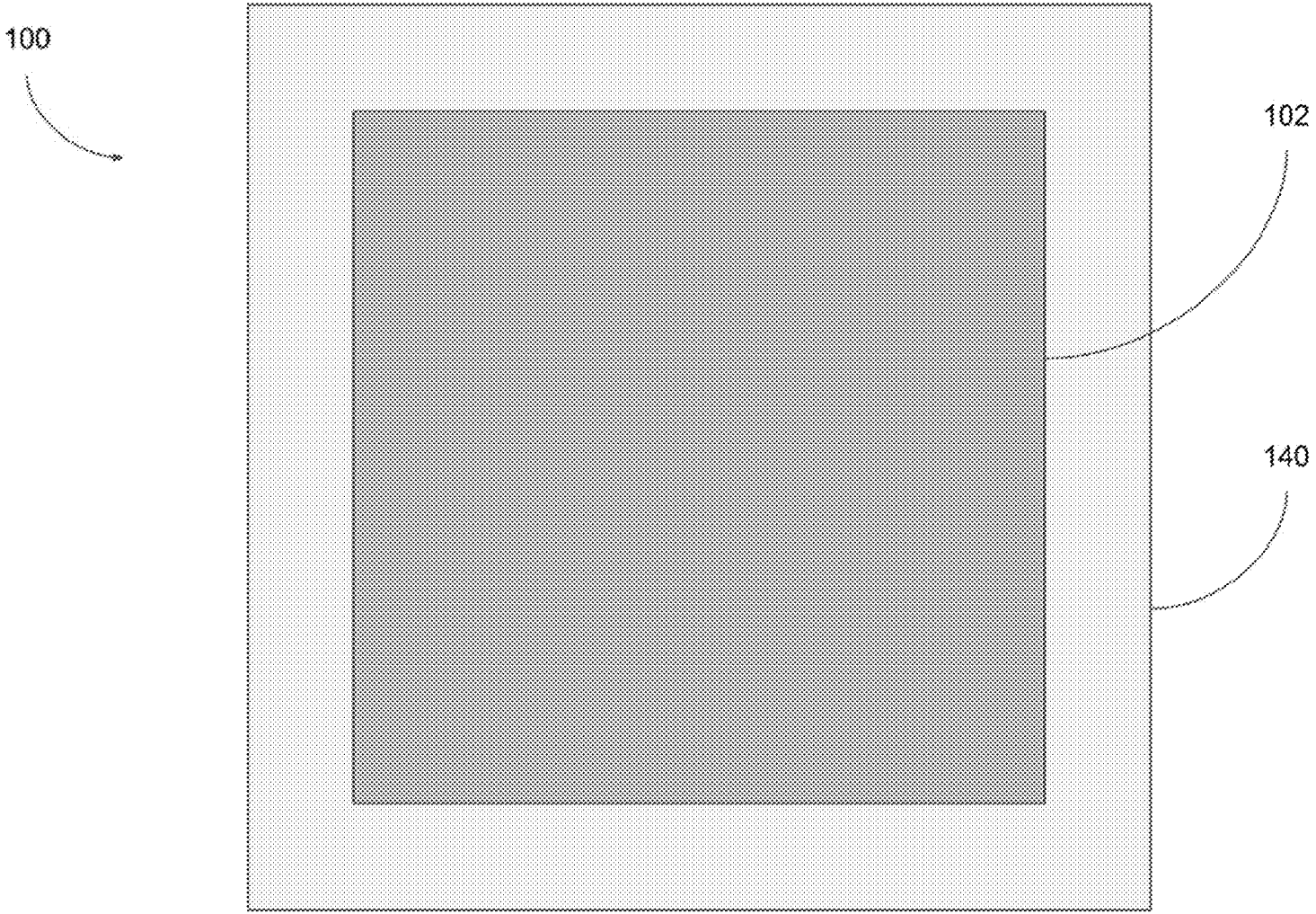

FIG. 9 shows an embodiment of the hot tub of the present invention comprising a transfer compartment completely surrounding the hot tub compartment/

Figure 10A:
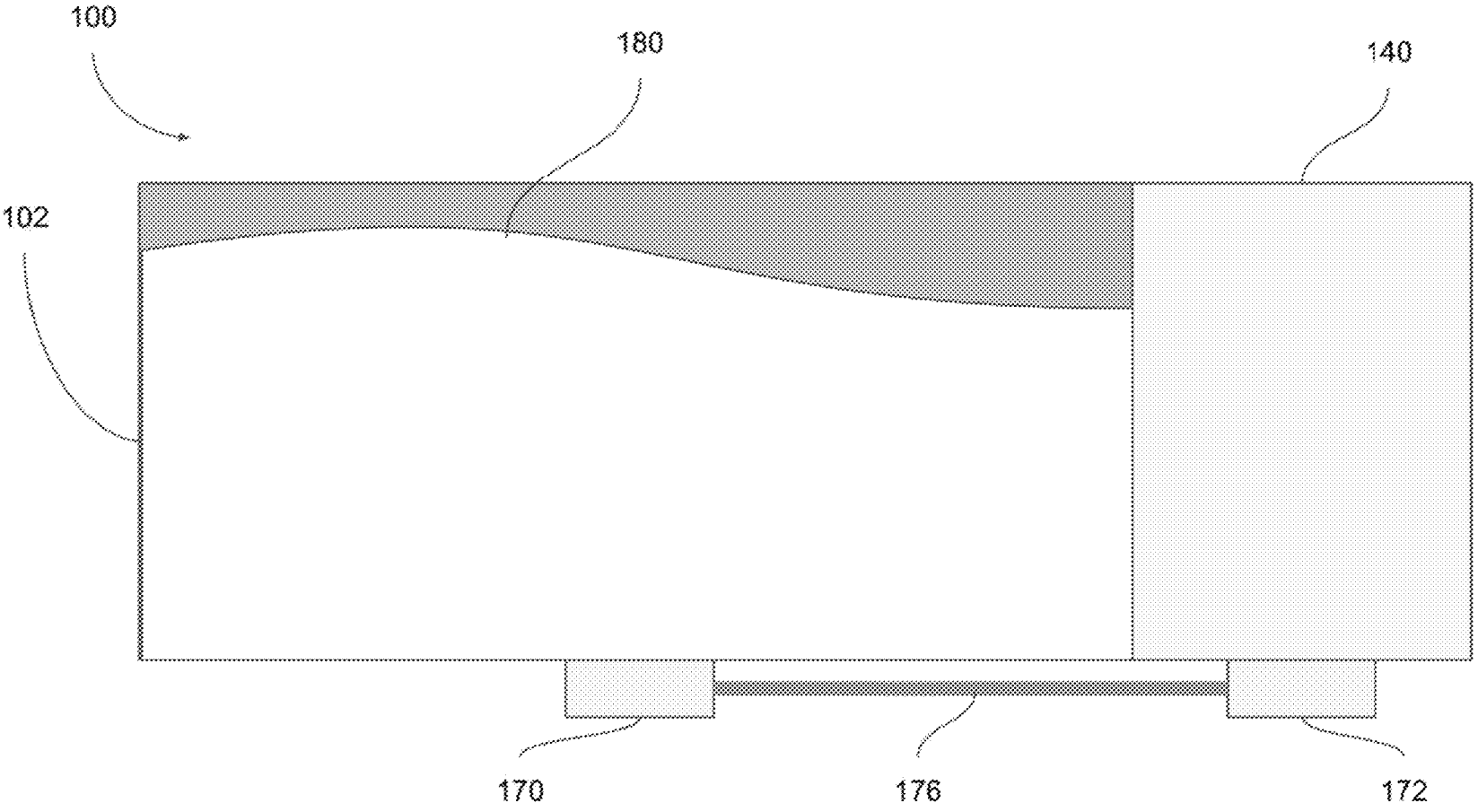
Figure 10B:
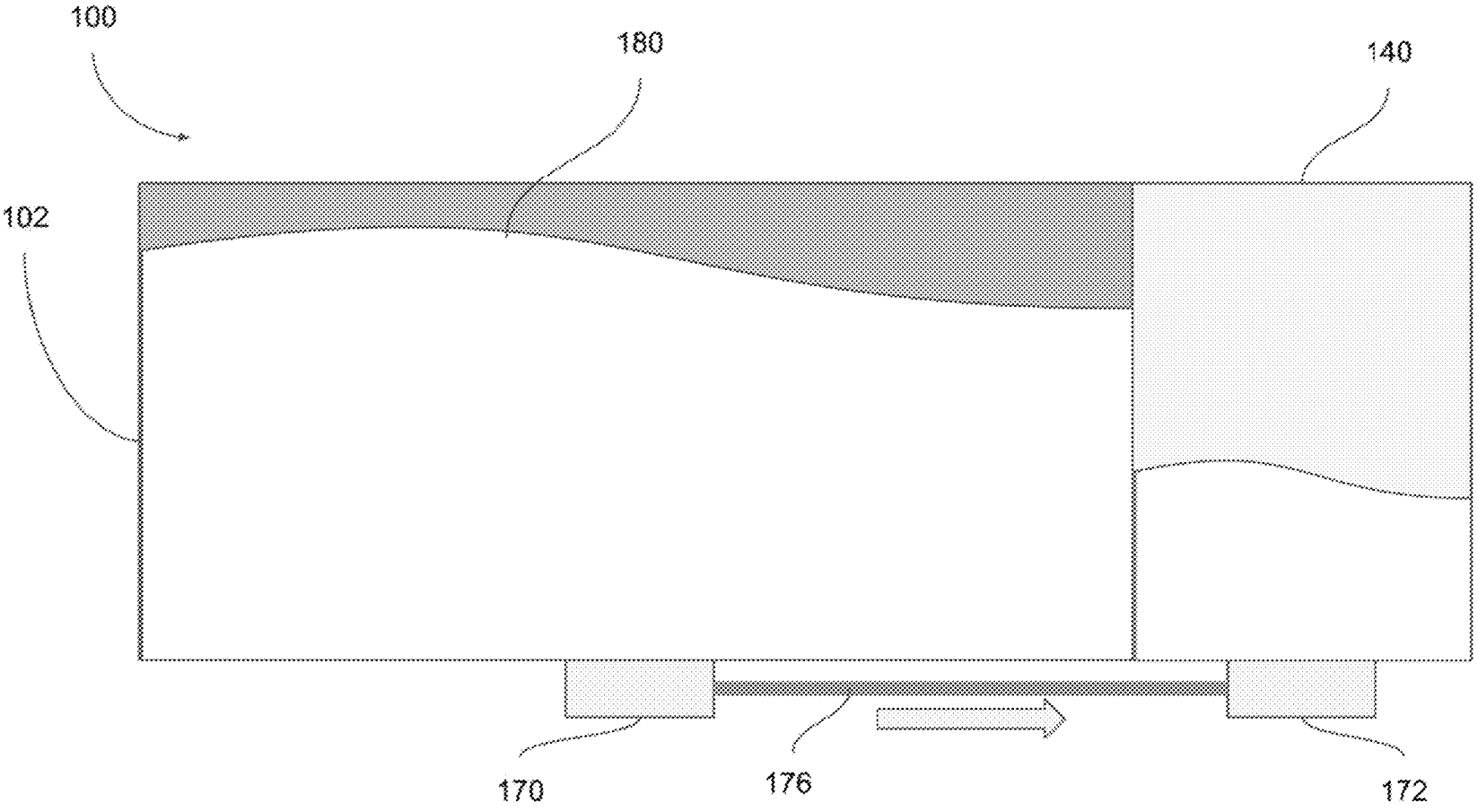
Figure 10C:
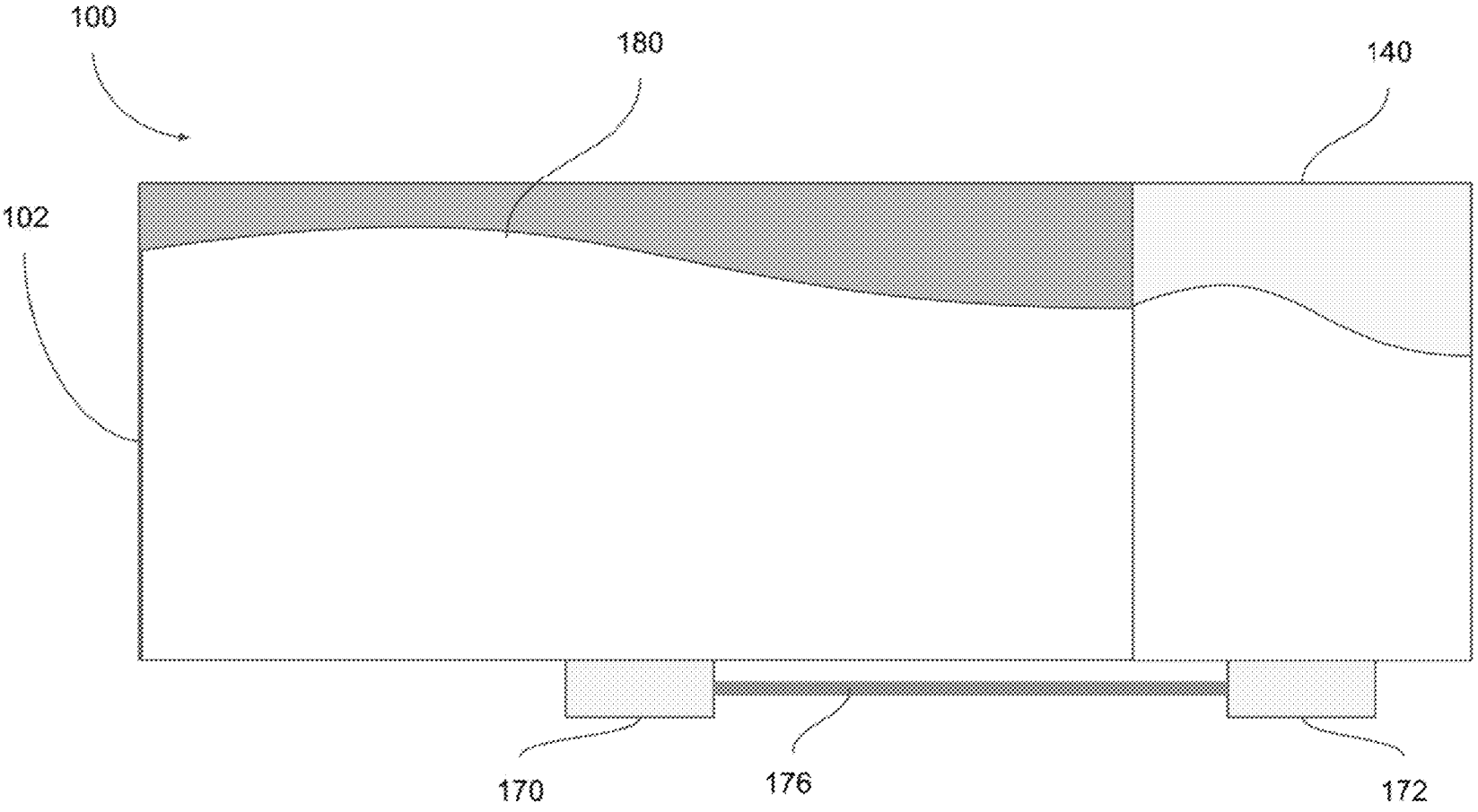
Figure 10D:
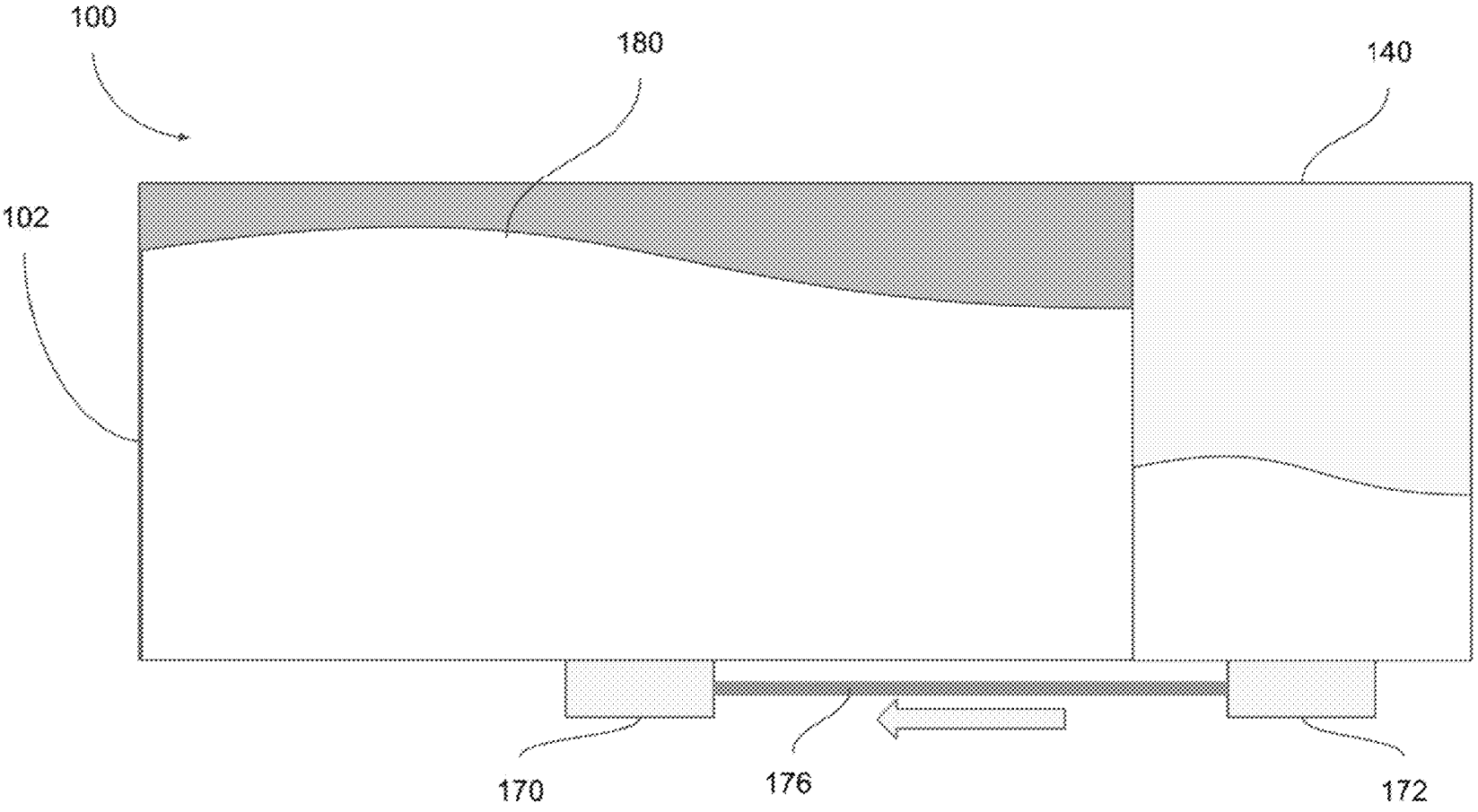
Figure 10E:
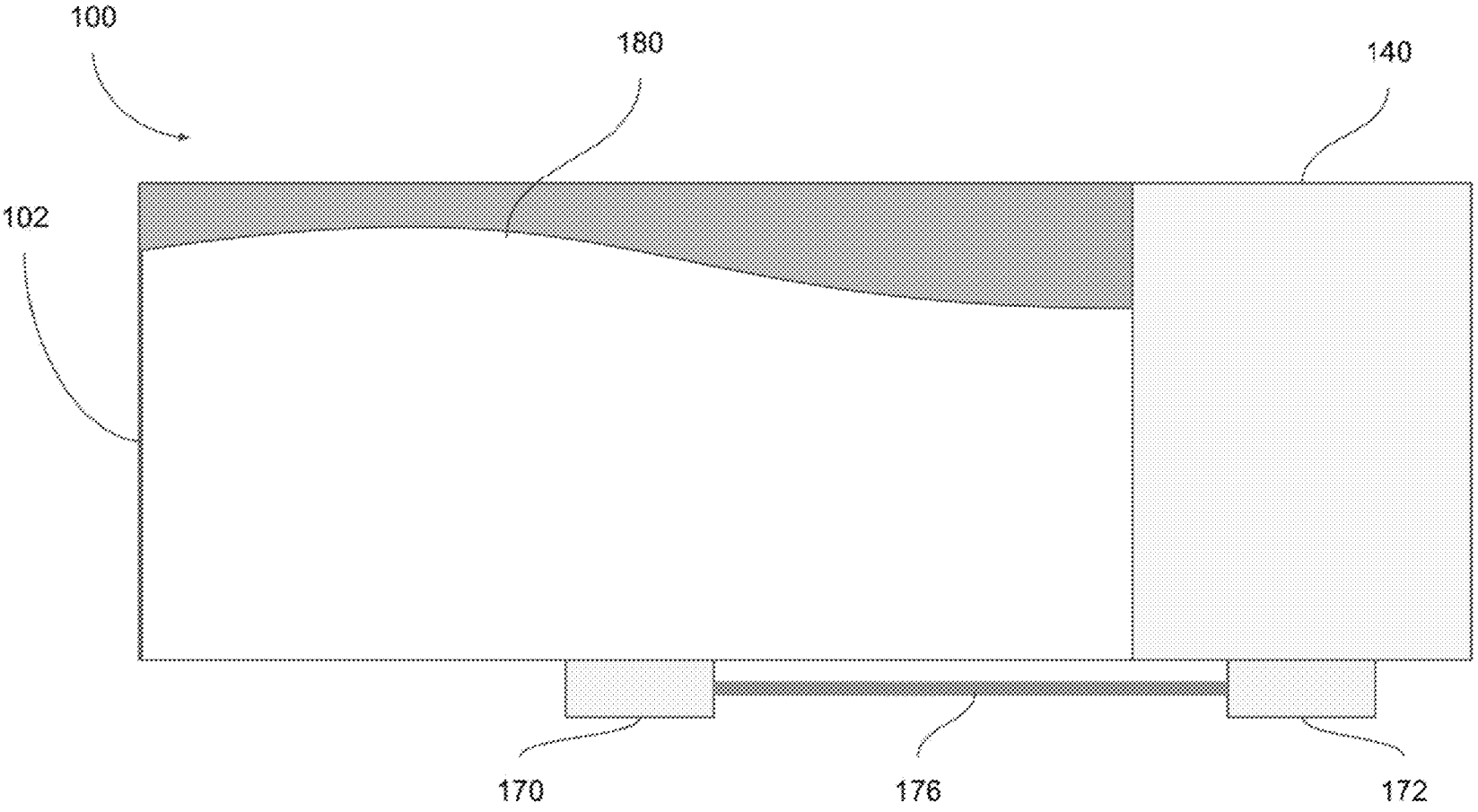

FIGS. 10A-10E shows a sequence of water flowing back and forth between the hot tub compartment and the transfer compartment. The transfer compartment begins in a dry and empty state (FIG. 10A). When the user enters the transfer compartment, water is pumped into the transfer compartment (FIG. 10B) until it is completely full and the user can enter the hot tub compartment (FIG. 100). When the user wishes to leave the hot tub, the user enters the transfer compartment and water is then pumped from the transfer compartment back to the hot tub compartment (FIG. 10D) until the transfer component is empty of water, allowing the user to exit the hot tub in a dry state (FIG. 10E).

Like reference numerals refer to like parts throughout the several views of the drawings.

DETAILED DESCRIPTION OF THE INVENTION

Following is a list of elements corresponding to a particular element referred to herein:

100 hot tub
102 hot tub compartment
104 front wall segment
106 side wall segments
108 rear wall segment
110 front corners
112 rear corners
116 inner tub wall
118 tub floor
120 hot tub compartment interior
124 water jet opening
126 water jet nozzle
128 hot tub compartment drain opening
134 tub seat
140 hot tub transfer compartment
142 transfer compartment wall
144 side transfer compartment wall
146 transfer compartment interior
148 transfer compartment floor
150 transfer compartment door opening
152 exterior transfer compartment door
154 transfer compartment drain opening
156 hot tub compartment door opening
158 hot tub compartment door
164 sloped entry ramp
168 pump system
170 tub pump
172 transfer compartment pump
174 water filter
176 transfer compartment pump conduit
178 water heater
180 water
182 tub pump conduit The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a walk-in hot tub which may enable a user to walk into and out of the hot tub in a dry state.

Referring initially to FIGS. 1-8, a walk-in hot tub, hereinafter hot tub 100, is illustrated in accordance with an exemplary embodiment of the present invention. As shown for instance in FIG. 1, the hot tub 100 may include a hot tub compartment 102. The hot tub compartment 102 may have a hot tub compartment interior 120. A hot tub transfer compartment 140 may be disposed adjacent to the hot tub compartment 102. The hot tub transfer compartment 140 may have a transfer compartment interior 146.

An exterior transfer compartment door 152 may provide access to the transfer compartment interior 146 of the hot tub transfer compartment 140 from outside the hot tub 100. A hot tub compartment door 158 may provide access from the transfer compartment interior 146 of the hot tub transfer compartment 140 to the hot tub compartment interior 120 of the hot tub compartment 102.

As shown in FIGS. 5-8, in typical application of the walk-in hot tub 100, which will be hereinafter described, with the hot tub compartment door 158 closed, the hot tub compartment interior 120 of the hot tub compartment 102 may be filled with water 180, as illustrated in FIG. 5. The transfer compartment door 152 may then be opened to enable one or more users (not illustrated) to walk into the transfer compartment interior 146, after which the transfer compartment door 152 may be closed.

As illustrated in FIG. 6, the hot tub compartment door 158 may next be opened to enable the user or users to walk from the transfer compartment interior 146 of the tub transfer compartment 140 into the hot tub compartment interior 120 of the hot tub compartment 102. The hot tub compartment door 158 may again be closed, as illustrated in FIG. 7.

After use of the hot tub 100, the hot tub compartment door 158 may again be opened to enable the user to walk from the hot tub compartment interior 120 back into the transfer compartment interior 146 of the tub transfer compartment 140, and the hot tub compartment door 158 closed. As further illustrated in FIG. 7, the water 180 may be drained from the transfer compartment interior 146 of the tub transfer compartment 140. The water 180 may be emptied from the transfer compartment interior 146 of the tub transfer compartment 140, as illustrated in FIG. 8, and the transfer compartment door 152 opened to enable the user to walk from the transfer compartment interior 146.

The hot tub compartment 102 may have any desired size and shape. As illustrated in FIGS. 1-4, in some embodiments, the hot tub compartment 102 may be square-shaped with a front wall segment 104; a pair of parallel, spaced-apart side wall segments 106 extending from the front wall segment 104; and a rear wall segment 108 extending between the side wall segments 106. A pair of front corners 110 may connect the front wall segment 104 to the respective side wall segments 106. A pair of rear corners 112 may connect the rear wall segment 108 to the respective side wall segments 106.

Each of the front wall segment 104, the side wall segments 106 and the rear wall segment 108 may have an inner tub wall 116. The hot tub compartment interior 120 may be formed by the inner tub wall 116. A tub floor 118 may be recessed in the inner tub wall 116 of the front wall segment 104, the side wall segments 106 and the rear wall segment 108. At least one hot tub compartment drain opening 128 may extend through the tub floor 118.

A plurality of water jet openings 124 may extend through the inner tub wall 116 of at least one of the front wall segment 104, the side wall segments 106 and the rear wall segment 108. A water jet nozzle 126 (FIGS. 5-8), which may be standard or conventional, may be disposed in the front wall segment 102, each side wall segment 106 and/or the rear wall segment 108. Each water jet nozzle 126 may interface with a corresponding water jet opening 124.

As illustrated in FIGS. 5-8, at least one pump system 168 may be disposed in fluid communication with the hot tub compartment drain opening 128 and the water jet nozzles 126 which interface with the respective water jet openings 124. The pump system 168 may include at least one tub pump 170. The tub pump 170 may be disposed in fluid communication with the hot tub compartment drain opening 128. A tub pump conduit 182 may be disposed in fluid communication with the tub pump 170. At least one water filter 174 and at least one water heater 178 may be disposed in fluid communication with the tub pump conduit 182 (e.g. along the tub pump conduit). Each water jet nozzle 126 may be disposed in fluid communication with the water filter 174 and the water heater 178. The tub pump 170 may be connected to an external source of water (not illustrated). Accordingly, responsive to operation of the tub pump 170 and the water heater 178, the tub pump 170 may continuously pump water through the water filter 174 and the water heater 178. The heated water may be discharged from the water jet nozzles 126 through the respective water jet openings 124 into the hot tub compartment interior 120 of the hot tub compartment 102, respectively. The water 180 may then be drained from the hot tub compartment interior 120 through the hot tub compartment drain opening 128 back to the hot tub pump 170 and circulate back through the tub pump conduit 182, the water filter 174, the water heater 178 and the water jet nozzles 126, respectively, back into the hot tub compartment interior 120.

In some embodiments, at least one tub seat 134 may be provided in the hot tub compartment interior 120 of the hot tub compartment 102, typically beneath the water jet openings 124. The tub seat 134 may extend along the interior of at least one of the front wall segment 104, the side wall segments 106 and the rear wall segment 108. In some embodiments, the tub seat 134 may be continuous and may extend along the interior of the front wall segment 104, the side wall segments 106 and the rear wall segment 108.

As further illustrated in FIGS. 1-4, the tub transfer compartment 140 may include a transfer compartment floor 148 (FIGS. 3 and 4). At least one transfer compartment wall 142, 144 may extend from the transfer compartment floor 148. The transfer compartment walls 142, 144 may separate the transfer compartment interior 146 of the tub transfer compartment 140 from the hot tub compartment interior 120 of the hot tub compartment 102.

In some embodiments, the at least one transfer compartment wall may include an inner transfer compartment wall 142 and a side transfer compartment wall 144. The inner transfer compartment wall 142 may extend from one of the side wall segments 106. The side transfer compartment wall 144 may extend from the front wall segment 104 to the inner transfer segment wall 142. Accordingly, a transfer compartment door opening 150 may extend through the front wall segment 104. The transfer compartment door 152 may be disposed within the transfer compartment door opening 150. A hot tub compartment door opening 156 may extend through the inner transfer compartment wall 142. The hot tub compartment door 158 may be disposed within the hot tub compartment door opening 156.

In some embodiments, a sloped entry ramp 164 may extend from the transfer compartment door opening 150. The entry ramp 164 may facilitate ease in ingress and egress to the transfer compartment interior 146 of the tub transfer compartment 140.

In some embodiments, the transfer compartment door 152 may be pivotally mounted in the transfer compartment door opening 150. In other embodiments, the transfer compartment door 152 may be slidably mounted in the transfer compartment door opening 150. The transfer compartment door opening 150 may include gaskets and/or other seals (not illustrated) which facilitate a fluid-tight seal with the transfer compartment door 152 when the transfer compartment door 152 is closed in the transfer compartment door opening 150.

In some embodiments, the hot tub compartment door 158 may be pivotally mounted in the hot tub compartment door opening 156. In other embodiments, the hot tub compartment door 158 may be slidably mounted in the hot tub compartment door opening 156. The hot tub compartment door opening 156 may include gaskets and/or other seals (not illustrated) which facilitate a fluid-tight seal with the hot tub compartment door 158 when the hot tub compartment door 158 is closed in the hot tub compartment door opening 156.

At least one transfer compartment drain opening 154 may extend through the transfer compartment floor 148 of the tub transfer compartment 140. As illustrated in FIGS. 5-8, at least one transfer compartment pump 172 may be disposed in fluid communication with the transfer compartment drain opening 154. A transfer compartment pump conduit 176 may be disposed in fluid communication with the transfer compartment pump 172. Accordingly, the transfer compartment pump 172 may be operably configured to pump water 180 from the transfer compartment interior 146 in operation of the hot tub 100.

Referring again to FIGS. 5-8, in typical application of the walk-in hot tub 100, the transfer compartment door 152 and the hot tub compartment door 158 may initially be deployed in the closed positions in the respective transfer compartment door opening 150 and hot tub compartment door opening 156. As illustrated in FIG. 5, the hot tub compartment interior 120 of the hot tub compartment 102 may be filled with water 180. The transfer compartment door 152 may next be opened to enable one or more users (not illustrated) to walk typically up the sloped entry ramp 164 through the open transfer compartment door opening 150 into the transfer compartment interior 146, after which the transfer compartment door 152 may be closed.

As illustrated in FIG. 6, the hot tub compartment door 158 may next be opened to enable the user or users to walk from the transfer compartment interior 146 of the tub transfer compartment 140 through the open hot tub compartment door opening 156 into the hot tub compartment interior 120 of the hot tub compartment 102. Simultaneously, water 180 may flow from the hot tub compartment interior 120 through the hot tub compartment door opening 156 into the transfer compartment interior 146, as illustrated in FIG. 7. The hot tub compartment door 158 may again be closed, as illustrated in FIG. 7.

In some embodiments, at least one water bladder (not illustrated) may be disposed in fluid communication with the transfer compartment interior 146 of the tub transfer compartment 140. The water bladder may be suitably configured to contain a sufficient quantity of water to fill the transfer compartment interior 146 and maintain a constant level of the water 180 in the transfer compartment interior 146 preparatory to opening of the hot tub compartment door 158 when the hot tub compartment interior 120 is filled with water. 180. Accordingly, the water 180 in the transfer compartment interior 146 may balance out the water 180 in the hot tub compartment interior 120 to facilitate opening of the hot tub compartment door 158.

Throughout use of the hot tub 100, the pump system 168 may pump, filter, heat and circulate the water 180 from the hot tub compartment interior 120 through the hot tub compartment drain opening 128, the tub pump conduit 182, the filter 174 and the water heater 178 and discharge the water 180 through the water jet nozzles 126 and the respective water jet openings 124 into the hot tub compartment interior 120, respectively.

After use of the hot tub 100 is completed, the hot tub compartment door 158 may again be opened to enable the user to walk from the hot tub compartment interior 120 back into the transfer compartment interior 146 of the tub transfer compartment 140, and the hot tub compartment door 158 closed. As further illustrated in FIG. 7, the water 180 may be drained from the transfer compartment interior 146 of the tub transfer compartment 140 until the transfer compartment interior 146 of the tub transfer compartment 140 is empty, as illustrated in FIG. 8. Draining of the water 180 from the transfer compartment interior 146 may be accomplished by operation of the transfer compartment pump 172 of the pump system 168. The transfer compartment door 152 may then be opened to enable the user to walk from the transfer compartment interior 146 typically down the sloped entry ramp 164.

In some embodiments, the hot tub and the transfer component can be configured in a plurality of different arrangements. For example, as shown in FIG. 9, the transfer compartment may be surrounding the hot tub compartment. In other embodiments, the transfer compartment may be coupled to the hot tub compartment as an isolated chamber not surrounding the hot tub compartment.

In some embodiments, the pump system may be controlled by a computing system comprising a processor capable of executing computer-readable instructions, a memory component comprising a plurality of computer-readable instructions, and an input component allowing for the user to trigger the processor to execute computer-readable instructions stored in the memory component. The plurality of computer-readable instructions may comprise pumping water from the hot tub compartment to the transfer compartment until the height of water in the transfer compartment is level with that of the hot tub compartment through use of the transfer pump, and pumping water from the transfer compartment to the hot tub compartment until the transfer compartment is empty through use of the transfer pump. The computing system may additionally be capable of controlling the temperature and number of active jets in the hot tub compartment.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A walk-in hot tub (100) which enables a user to walk into and out of the hot tub (100) in a dry state, comprising:

a. a hot tub compartment (102);

b. a tub transfer compartment (140) coupled to the hot tub compartment (102), comprising a transfer compartment door (152) configured to move between closed and opened positions allowing entry to and exit from the hot tub (100), and a hot tub compartment door (158) configured to move between closed and opened positions coupling the tub transfer compartment (140) to the hot tub compartment (102); and c. a transfer compartment pump (172) disposed in fluid communication with the tub transfer compartment (140);

wherein the transfer compartment pump (172) is configured to pump water (180) to and from the tub transfer compartment (140), allowing the user to walk into and out of the hot tub (100) in a dry state.

2. The walk-in hot tub (100) of claim 1, further comprising:

a. a hot tub compartment drain opening (128) disposed on a tub floor (118) of the hot tub compartment (102);

b. one or more water jet nozzles (126) disposed on an inner tub wall (116) of the hot tub compartment (102); and c. a hot tub pump (170) fluidly connected to the hot tub compartment drain opening (128) and the one or more water jet nozzles (126) by a tub pump conduit (182), configured to pump the water (180) from the hot tub compartment drain opening (128) through the one or more water jet nozzles (126) in order to circulate the water (180) in the hot tub compartment (102).

3. The walk-in hot tub (100) of claim 2, wherein the transfer compartment pump (172) is fluidly connected to the hot tub pump (170) by a transfer compartment pump conduit (176) such that the water (180) pumped from the transfer compartment (140) is transferred by the hot tub pump (170) through the one or more water jet nozzles (126) to the hot tub compartment (102).

4. The walk-in hot tub (100) of claim 2 further comprising one or more water heaters (178) disposed along the tub pump conduit (182) such that the water (180) pumped by the hot tub pump (170) is heated.

5. The walk-in hot tub (100) of claim 2 further comprising one or more water filters (174) disposed along the tub pump conduit (182) such that the water (180) pumped by the hot tub pump (170) is filtered.

6. The walk-in hot tub (100) of claim 2, wherein the hot tub pump (170) is fluidly connected to an external source of water such that the hot tub compartment (102) can be refilled.

7. The walk-in hot tub (100) of claim 1, wherein the transfer compartment door (152) comprises a gasket to facilitate a fluid-tight seal when the transfer compartment door (152) is in the closed position, wherein the hot tub compartment door (158) comprises a gasket to facilitate a fluid-tight seal when the hot tub compartment door (158) is in the closed position.

8. The walk-in hot tub (100) of claim 1, wherein the hot tub compartment (102) further comprises a tub seat (134).

9. The walk-in hot tub (100) of claim 1 further comprising a sloped entry ramp (164) coupled to the transfer compartment door (152).

10. The walk-in hot tub (100) of claim 1 further comprising a water bladder fluidly connected to the transfer compartment (140), configured to contain a sufficient quantity of water to fill the transfer compartment (140) and maintain a constant level of the water (180) in the transfer compartment (140) preparatory to opening of the hot tub compartment door (158).

11. A walk-in hot tub (100) which enables a user to walk into and out of the hot tub (100) in a dry state, comprising:

a. a hot tub compartment (102) having a hot tub compartment interior (120);

b. a tub transfer compartment (140) having a transfer compartment interior (146) adjacent to the hot tub compartment (102);

c. a transfer compartment door opening (150) communicating with the transfer compartment interior (146) of the tub transfer compartment (140);

d. a transfer compartment door (152) configured to move between closed and opened positions in the transfer compartment door opening (150);

e. a hot tub compartment door opening (156) establishing communication between the transfer compartment interior (146) of the tub transfer compartment (140) and the hot tub compartment interior (120) of the hot tub compartment (102);

f. a hot tub compartment door (158) configured to move between closed and opened positions in the hot tub compartment door opening (156); and g. a pump system (168) including:

i. a tub pump (170) disposed in fluid communication with the hot tub compartment interior (120) of the hot tub compartment (102);

ii. at least one water heater (178) disposed in fluid communication with the tub pump (170); and iii. at least one transfer compartment pump (172) disposed in fluid communication with the transfer compartment interior (146) of the tub transfer compartment (140) and the tub pump (170);

wherein the transfer compartment pump (172) is configured to pump water (180) to and from the tub transfer compartment (140), allowing the user to walk into and out of the hot tub (100) in a dry state.

12. The walk-in hot tub (100) of claim 11 further comprising one or more water filters (174) in fluid communication with the tub pump (170) such that the water (180) pumped by the hot tub pump (170) is filtered.

13. The walk-in hot tub (100) of claim 11, wherein the hot tub compartment (102) further comprises a tub seat (134).

14. The walk-in hot tub (100) of claim 11 further comprising a sloped entry ramp (164) coupled to the transfer compartment door (152).

15. The walk-in hot tub (100) of claim 11, wherein the pump system (168) is fluidly connected to an external source of water.

16. The walk-in hot tub (100) of claim 11, wherein the transfer compartment door (152) comprises a gasket to facilitate a fluid-tight seal when the transfer compartment door (152) is in the closed position, wherein the hot tub compartment door (158) comprises a gasket to facilitate a fluid-tight seal when the hot tub compartment door (158) is in the closed position.

17. The walk-in hot tub (100) of claim 11 further comprising a water bladder fluidly connected to the transfer compartment (140), configured to contain a sufficient quantity of water to fill the transfer compartment (140) and maintain a constant level of the water (180) in the transfer compartment (140) preparatory to opening of the hot tub compartment door (158).

* * * * *